United States Patent [19]

Busch

[11] Patent Number: 4,562,958

[45] Date of Patent: Jan. 7, 1986

[54] METHOD AND DEVICE FOR SPRAYING A LIQUID OR A SUSPENSION

[75] Inventor: Georg W. Busch, Hamburg, Fed. Rep. of Germany

[73] Assignee: Mantis ULV-Spruehgeraete GmbH, Hamburg, Fed. Rep. of Germany

[21] Appl. No.: 438,898

[22] PCT Filed: Feb. 27, 1982

[86] PCT No.: PCT/EP82/00041

§ 371 Date: Oct. 27, 1982

§ 102(e) Date: Oct. 27, 1982

[87] PCT Pub. No.: WO82/03026

PCT Pub. Date: Sep. 16, 1982

[30] Foreign Application Priority Data

Mar. 5, 1981 [DE] Fed. Rep. of Germany ..... 3108292

[51] Int. Cl.[4] ..... B05B 3/10

[52] U.S. Cl. ..... 239/7; 239/224

[58] Field of Search ..... 239/224, 7

[56] References Cited

U.S. PATENT DOCUMENTS

| | | | |
|---|---|---|---|
| 1,973,051 | 9/1934 | Doolittle | 239/224 |
| 3,086,712 | 4/1963 | Frazier | 239/224 |

FOREIGN PATENT DOCUMENTS

| | | | |
|---|---|---|---|
| 665655 | 1/1952 | United Kingdom | 239/224 |
| 751609 | 4/1956 | United Kingdom | 239/224 |

*Primary Examiner*—Jeffrey V. Nase
*Assistant Examiner*—Mary Beth O. Jones
*Attorney, Agent, or Firm*—Michael J. Striker

[57] ABSTRACT

Spraying of liquid or a suspension is performed under the action of a centrifugal disc which is rotatable about an axis of rotation and has an oblique outer annular skirt which generates a spray cone of small droplets, and during the rotation of the centrifugal disc a gas stream is formed in the spray cone and directed from inside the spray cone axially toward the centrifugal disc so as to form a centripetal gas flow extending in a direction transverse to the axis of rotation and reducing the diameter of the spray cone.

18 Claims, 2 Drawing Figures

METHOD AND DEVICE FOR SPRAYING A LIQUID OR A SUSPENSION

Figure 1:
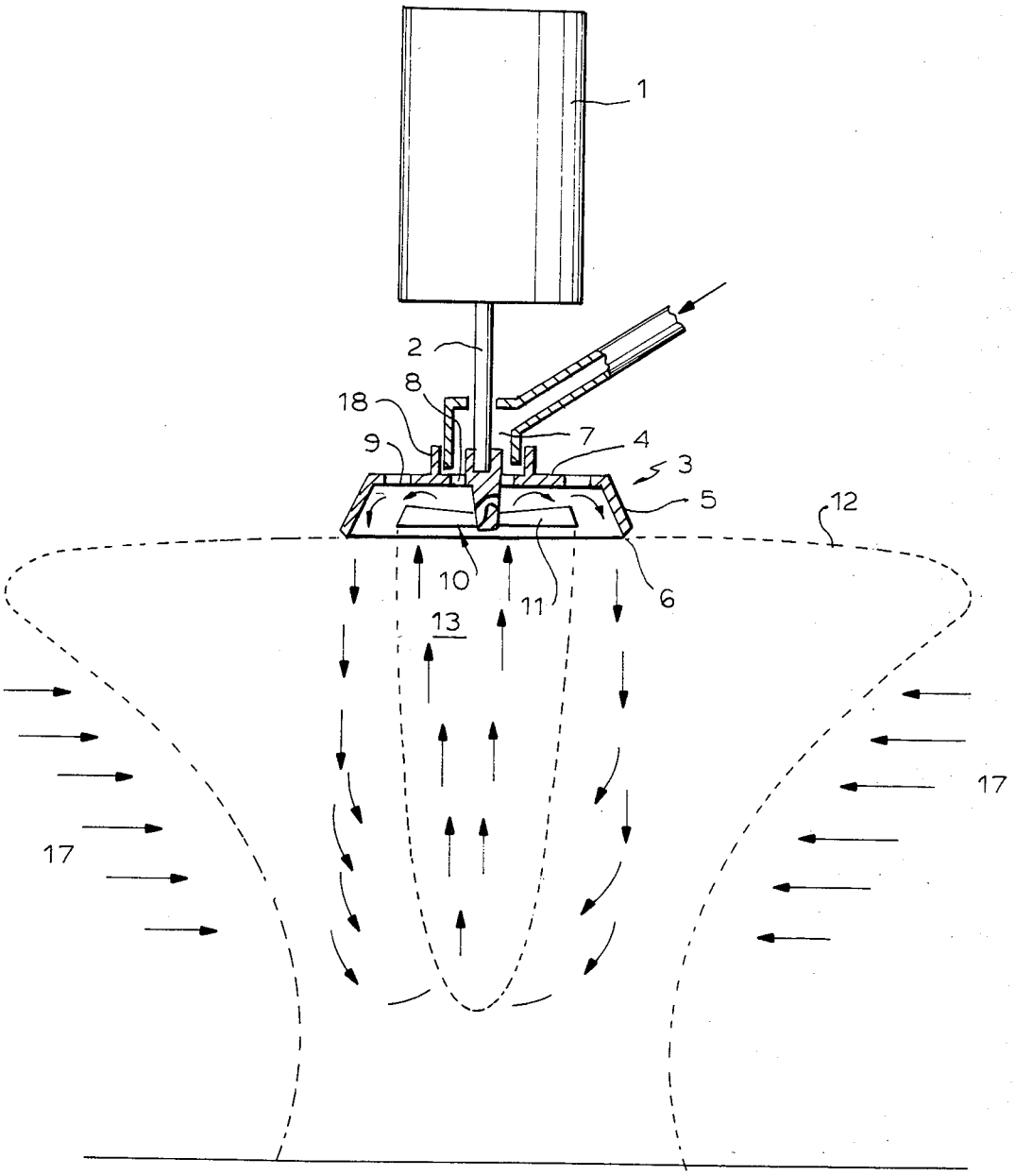

The invention relates to a method for spraying a liquid or suspension by means of centrifuging a spray cone of small droplets from a rotating centrifugal disc, as well as a corresponding spray device with a drive shaft which is activated into a rapid rotation by means of a drive device, at least one centrifugal disc mounted on the drive shaft for operating a spray cone of small droplets, as well as feeding devices for applying of the liquid to be sprayed onto the centrifugal disc.

In known methods and test devices of this type, the direction of the spray cone is influenced by the diameter of the centrifugal disc and its number of rotation. For obtaining a sufficiently fine and uniform droplet size, it is required to drive the centrifugal disc at a very high number of rotations of, for example, 10,000 RPM. Thereby, one can achieve a very uniform droplet size of, for example, 35 u, however the hollow cone which is generated during spraying has a relative large diameter of, for example, 100 to 120 cm which is undesirable for many application purposes.

It is therefore an object of the invention to provide a method for spraying of a liquid or suspension, a corresponding spraying device or a suitable centrifugal disc which obtains in a simple manner the generation of a spray cone of a reduced diameter without impairing the uniformness and fineness of the generated droplet size.

To solve this object of the invention, the aforementioned method is characterized in accordance with the invention by a device and a method in which means and steps are provided for supplying a liquid or a suspension to a centrifugal disc rotatable about an axis of rotation and having an outer annular skirt so that the liquid flows toward and along said outer annular skirt and then off the latter so as to generate a spray cone of small droplets, and for generating during rotation of said centrifugal disc a gas stream directed from inside said spray cone in an axial direction toward said centrifugal disc so as to form a centripetal gas flow extending in a direction transverse to said axial directions and reducing the diameter of said spray cone.

The inventive method and the inventive spray devices enable in a simply, inexpensive manner to substantially reduce the diameter of the generated spray cone with respect to known devices, without impairing the fineness and uniformity of the droplet size.

For example, with a centrifugal disc which has an outside diameter of 5 cm, a spray cone with a diameter of only 25 to 35 cm can be generated, without impairing the fineness and the uniformity of the droplet size. The advantages of the inventive device are particularly accentuated when spraying relative concentrated liquids or suspensions, wherein non-uniformity in the droplet size are particularly disadvantageous on the sprayed articles, due to the non-uniform distribution of the spray good.

The inventive method and the inventive spray devices are particularly suitable when faces of a relative small dimension should be treated, without an undesirable spraying of adjacent areas. For example, this is the case when spraying goods which are mounted on a relative small conveyor belt, whereby the diameter of the spray cone should not exceed the width of the conveyor belt.

In the following, preferred embodiments of the inventive spray device are further explained in conjunction with the appended drawings.

The drawings show:

FIG. 1 a schematic cross section through a spray device and

Figure 2:
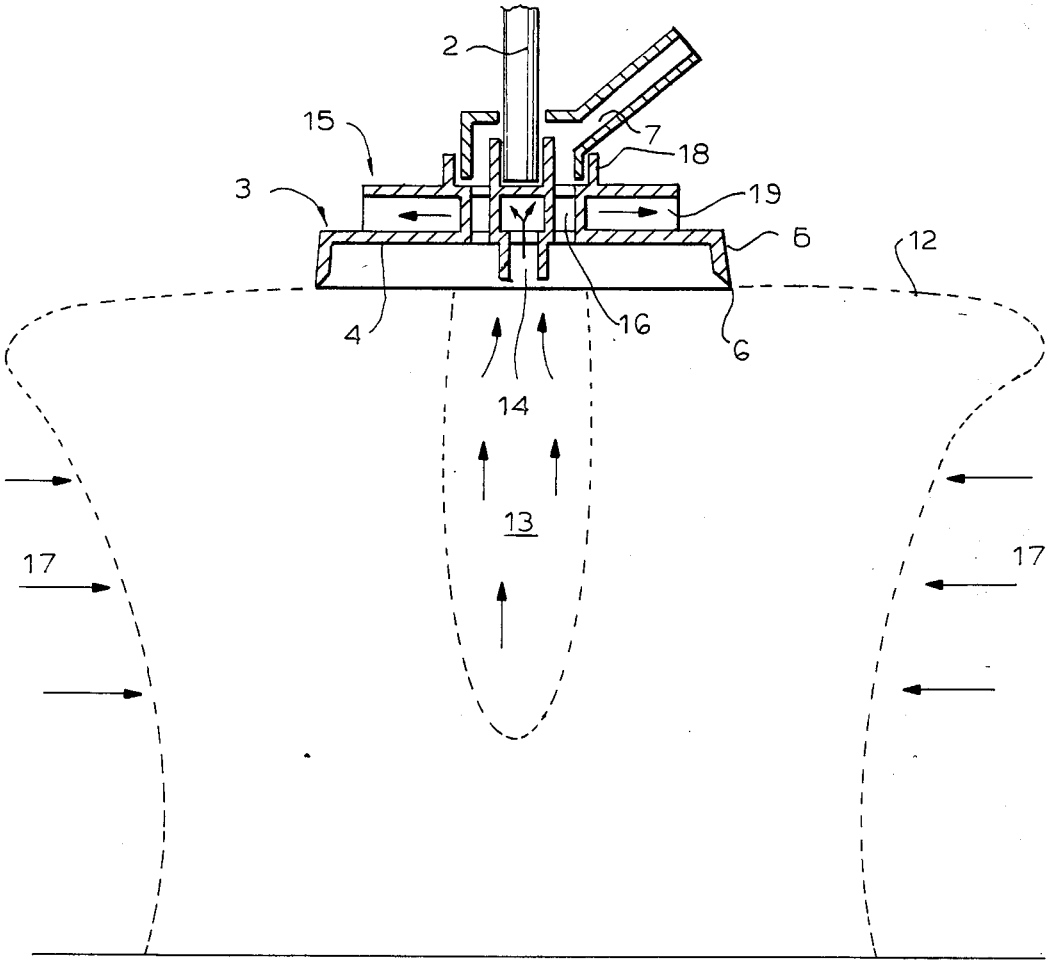

FIG. 2 a schematic cross section through a modified spray device.

The spray device shown in FIG. 1 is provided with a battery operated drive motor 1 on the drive shaft 2 of which a centrifugal disc 3 is detachably mounted. The centrifugal disc 3 is provided with a substantially radially extending disc segment 4 and at its outer edge obliquely bevelled edge plate 5 whose outer spray edge 6 is shaped in a known manner with fine saw tooth serrations (serration width about 0.5 mm), which is not shown in the drawings for purposes of clarity. A propeller 10 is disposed in the inner chamber of centrifugal disc 3 which is enclosed by the edge plate 5, whereby the propeller is detachably connected with the centrifugal disc 3 and is provided with a plurality of propeller blades 11 which are so shaped an directed that the propeller 10 during its common rotation with the centrifugal disc 3, generates an axial air flow towards the centrifugal disc, so that at the vacuum side of the propeller 10 facing away from the centrifugal disc 3 a vacuum zone 13 is formed.

A supply conduit 7 for the liquid to be sprayed is stationary disposed around drive shaft 2. The liquid which is supplied therethrough is prevented from a radial discharge by the ring plate 18 which is displaced on the centrifugal disc 3 and flows through the throughput opening 8 in the proximity of disc segment 4 to the side of the disc segment 4 facing the propeller 10 from where it is fed under the effect of centrifugal force onto the inner face of the edge plate 5 to the saw tooth like serrated spray edge 6 and then are centrifuged from the acute protruding serrations in form of thin liquid jets which immediately divide into droplets of practically the same size. The centrifuged liquid droplets move radially outward under the influence of the centrifugal force, on the one hand, and simultaneously fall downwardly due to the effect of gravity, so that a hollow spray cone 12 is generated.

Due to the vacuum pressure zone 13 formed on the suction side of the propeller 10 due to its rotation, a pressure drop is generated which generates a substantially inwardly directed flow of air which is present laterally outside of the spray cone. This centripetal flow 17 results in that the diameter of the spray cone 12 is substantially smaller in comparison to conventional devices, without impairing in any way the fineness and the uniformity of the droplet size.

In the modified embodiment illustrated in FIG. 2, a blow wheel 15 is provided on the centrifugal disc 3, instead of propeller 10 at the side facing away from the spray cone which rotates together with the centrifugal disc 3 and accelerates with its blow wheel blades 19 the air disposed therebetween radially outward, whereby air is constantly vacuumed off through a suction opening 14 which communicates with the inner chamber of the spray cone 12, so that a vacuum pressure zone 13 is formed, which again generates a centripetal flow 17 being substantially directed to this vacuum pressure zone, so that a reduction of the diameter of the generated spray cone 12 is obtained.

Throughput conduits 16 are distributed at uniform distances over the circumference, so that the liquid to be sprayed from the supply conduit 7 cannot flow over to the side of the centrifugal disc 3 which faces the inside of the spray cone 12.

In the embodiment illustrated in FIG. 1, the air which is moved by the propeller 10 in the direction to the centrifugal disc 3 is so deflected on the disc segment 4 and the edge plate 5 that it discharges in a direction which is opposite to the prevailing axial direction of the flow in vacuum pressure zone 13 and is gradually deflected inwardly by the pressure drop. For controlling this circulation, gas throughout opening 9 may be provided in the disc segment 4 of the centrifugal disc 3, distributed over its circumference. The gas throughput openings are advantageously so designed by means of an oblique structure of their walls that the liquid to be sprayed is prevented from discharging through the gas throughput openings 9. However, in certain cases it may be desirable, by a corresponding structuring of the gas throughput openings to let a part of the supplied liquid flow over onto the outer face of the centrifugal disc 3. This is particularly true if the centrifugal disc is provided with a second edge plate 5, not shown.

The aforementioned spray device which was explained in conjunction with preferred embodiments can be modified by a person skilled in the art in fifferent efficient ways as long as a rotor is used for generating a vacuum pressure zone 13 within the spray cone 12 and by maintaining a centripetal flow 17. The diameter of the centrifugal disc 3, the design and the dimensions of the edge plate 5, the propeller 10 or the blow wheel 15, as well as the arrangement and the size of the throughput openings 8 and possible gas throughput openings 9 should be efficiently adjusted with respect to the type and the flow characteristics of the liquid or suspension to be sprayed, the desired droplet size and the desired diameter of the spray cone 12. The centrifugal disc is mounted in a conventional manner on the drive shaft by either a clamp screw of by means of a thread.

I claim:

1. A spray device for spraying a liquid or a suspension, comprising means for supplying a liquid or a suspension; a centrifugal disc rotatable about an axis of rotation and communicating with said supplying means, said centrifugal disc having an outer annular skirt formed so that when a liquid or a suspension is supplied from said supplying means into said centrifugal disc it flows toward and along said outer annular skirt and then off the latter so as to generate a spray cone of small droplets flowing away from said skirt; means for rotating said centrifugal disc about said axis of rotation; and a rotor rotatable together with said centrifugal disc about said axis of rotation and generating during the rotation a gas stream directed from inside of said spray cone in an axial direction toward said centrifugal disc so as to form a centripetal gas flow which extends from outside of said spray cone in a direction transverse to said axial direction and thereby reduces the diameter of said spray cone.

2. A spray device as defined in claim 1, wherein said means for rotating said centrifugal disc includes a drive motor having a drive shaft, said centrifugal disc being mounted on said drive shaft of said drive motor.

3. A spray device as defined in claim 1, wherein said centrifugal disc also has a substantially radial disc portion connected with said outer annular skirt and rotating together with the latter, said rotor being connected with said radial disc portion for joint rotation therewith and having rotor blades which are formed so as to generate said gas stream directed from inside said spray cone in an axial direction toward said radial disc portion.

4. A spray device as defined in claim 3, wherein said radial disc portion has a side, said rotor with said rotor blades being connected with said radial disc portion at said side.

5. A spray device as defined in claim 4, wherein said radial disc portion and said outer annular skirt of said centrifugal disc together form an inner chamber, said rotor blades being arranged in said inner chamber.

6. A spray device as defined in claim 4, wherein said rotor blades and rotor are formed as one unitary piece with said centrifugal disc.

7. A spray device as defined in claim 3, wherein said means for supplying includes a stationary supply conduit having a discharge opening, said radial disc portion of said centrifugal disc having inlet openings provided substantially opposite to said discharge opening of said supply conduit.

8. A spray device as defined in claim 3, wherein said radial disc portion of said centrifugal disc has a radially outer area and is provided in said radially outer area with gas outlet openings.

9. A spray device as defined in claim 1, wherein said means for supplying includes a supply conduit, said centrifugal disc having a side which faces away from said oblique outer annular skirt and being provided at said side with an annular wall which surrounds said supply conduit without contacting the latter.

10. A spray device as defined in claim 1, wherein said outer annular skirt has an outer spray edge provided with serrations.

11. A spray device as defined in claim 1, wherein said annular skirt forms an inner chamber, said centrifugal disc having a side facing away from said inner chamber, said rotor including a coaxial centrifugal blower wheel provided at said side and communicating with said inner chamber.

12. A spray device as defined in claim 11, wherein said centrifugal disc has a suction opening which communicates said centrifugal blower wheel with said inner chamber.

13. A spray device as defined in claim 11, wherein said centrifugal blower wheel is of one piece with said centrifugal disc.

14. A spray device as defined in claim 11, wherein said centrifugal disc has a substantially radial disc portion and is provided at said side with a plurality of blades which together with said radial disc portion forms said blower wheel.

15. A spray device as defined in claim 14, wherein said supplying means includes a supply conduit provided with a stationary annular flange cooperating with said radial disc portion of said centrifugal disc.

16. A spray device as defined in claim 11, wherein said centrifugal disc also has a substantially radial disc portion which together with said annular skirt forms said inner chamber, said radial disc portion of said centrifugal disc being provided with through-going openings extending through said blower wheel and communicating said supplying means with said inner chamber.

17. A method for spraying liquid or a suspension, comprising the steps of supplying a liquid or a suspension to a centrifugal disc having an outer annular skirt; rotating said centrifugal disc about an axis of rotation so that the liquid flows toward and along said outer annular skirt and then off the latter so as to generate a spray cone of small droplets; rotating a rotor with said centrifugal disc to generate a gas stream directed from inside said spray cone in an axial direction toward said centrifugal disc so as to form a centripetal gas flow extending in a direction transverse to said axial directions and reducing the diameter of said spray cone.

18. A method as defined in claim 17, wherein said forming step includes forming said gas stream so that gas is permanently flown from inside of said spray cone through said centrifugal disc to a space outside of said spray cone.

* * * * *